US010115518B2

(12) United States Patent
Jeong

(10) Patent No.: US 10,115,518 B2
(45) Date of Patent: Oct. 30, 2018

(54) COIL ELECTRONIC COMPONENT

(71) Applicant: SAMSUNG ELECTRO-MECHANICS CO., LTD., Suwon-si, Gyeonggi-do (KR)

(72) Inventor: Dong Jin Jeong, Suwon-si (KR)

(73) Assignee: SAMSUNG ELECTRO-MECHANICS CO., LTD., Suwon-Si, Gyeonggi-Do (KR)

( * ) Notice: Subject to any disclaimer, the term of this patent is extended or adjusted under 35 U.S.C. 154(b) by 13 days.

(21) Appl. No.: 15/081,544

(22) Filed: Mar. 25, 2016

(65) Prior Publication Data

US 2016/0351318 A1 Dec. 1, 2016

(30) Foreign Application Priority Data

May 29, 2015 (KR) ..... 10-2015-0075953

(51) Int. Cl.

| | |
|---|---|
| ***H01F 5/00*** | (2006.01) |
| ***H01F 27/28*** | (2006.01) |
| ***H01F 27/29*** | (2006.01) |
| ***H01F 17/00*** | (2006.01) |
| *H01F 17/04* | (2006.01) |

(52) U.S. Cl.
CPC ..... *H01F 27/292* (2013.01); *H01F 17/0013* (2013.01); *H01F 2017/0066* (2013.01); *H01F 2017/048* (2013.01)

(58) Field of Classification Search
CPC ..... H01F 5/00; H01F 27/28; H01F 27/2804; H01F 27/29; H01F 27/255
USPC ..... 336/200, 232
See application file for complete search history.

(56) References Cited

U.S. PATENT DOCUMENTS

| | | | | |
|---|---|---|---|---|
| 6,392,525 | B1 * | 5/2002 | Kato | H01F 3/08 336/200 |
| 2010/0194511 | A1 | 8/2010 | Kobayashi et al. | |
| 2013/0002383 | A1 | 1/2013 | Esaki et al. | |
| 2013/0082813 | A1 | 4/2013 | Wi et al. | |
| 2013/0147591 | A1 * | 6/2013 | Kim | H01F 17/04 336/200 |
| 2013/0222101 | A1 * | 8/2013 | Ito | H01F 17/04 336/83 |

(Continued)

FOREIGN PATENT DOCUMENTS

| | | |
|---|---|---|
| CN | 101789303 A | 7/2010 |
| CN | 102859623 A | 1/2013 |

(Continued)

OTHER PUBLICATIONS

Korean Office Action dated Apr. 20, 2017 issued in Korean Patent Application No. 10-2015-0075953 (English translation).

(Continued)

*Primary Examiner* — Tsz Chan
(74) *Attorney, Agent, or Firm* — McDermott Will & Emery LLP

(57) ABSTRACT

A coil electronic component includes a substrate; a coil pattern formed on at least one of first and second main surfaces of the substrate; a body region filling at least a core region of the coil pattern and having a magnetic material; and a magnetic flux controlling part covering at least the coil pattern and having a material having a saturation magnetic flux density higher than that of a magnetic material contained in the body region.

18 Claims, 3 Drawing Sheets

(56) References Cited

U.S. PATENT DOCUMENTS

| | | | | |
|---|---|---|---|---|
| 2013/0249664 | A1* | 9/2013 | Tonoyama | H01F 41/04 336/200 |
| 2014/0197917 | A1* | 7/2014 | Naito | H01F 17/0013 336/200 |
| 2015/0109088 | A1 | 4/2015 | Kim et al. | |

FOREIGN PATENT DOCUMENTS

| | | | | |
|---|---|---|---|---|
| CN | 104575937 | A | | 4/2015 |
| JP | 2007-067214 | A | | 3/2007 |
| JP | 2007067214 | A | * | 3/2007 |
| JP | 2008072071 | A | * | 3/2008 |
| JP | 2010-192890 | A | | 9/2010 |
| JP | 2014041962 | A | * | 3/2014 |
| KR | 10-2012-0045949 | A | | 5/2012 |
| KR | 2013-0035473 | A | | 4/2013 |
| KR | 10-1434351 | B1 | | 8/2014 |

OTHER PUBLICATIONS

First Office Action issued in corresponding Chinese Patent Application No. 201610137386.X dated Sep. 19, 2017 (with full English translation).

* cited by examiner

COIL ELECTRONIC COMPONENT

CROSS-REFERENCE TO RELATED APPLICATION

This application claims benefit of priority to Korean Patent Application No. 10-2015-0075953 filed on May 29, 2015, with the Korean Intellectual Property Office, the disclosure of which is incorporated herein by reference.

TECHNICAL FIELD

The present disclosure relates to a coil electronic component.

BACKGROUND

An inductor corresponding to a coil electronic component is a representative passive element configuring an electronic circuit together with a resistor and a capacitor to remove noise.

The inductor may be classified into a multilayer type inductor, a thin film type inductor, and the like. Among them, the thin film type inductor is appropriate for being relatively thinly manufactured. Therefore, the thin film type inductor has recently been utilized in various fields, and an attempt to further decrease thickness of a component has been continuously conducted in accordance with the trend toward complexation, multi-functionalization, and slimness of set components. Accordingly, a scheme capable of securing high performance and reliability in spite of the trend toward the slimness of the coil electronic component in the related art has been demanded.

SUMMARY

An aspect of the present disclosure may provided a coil electronic component capable of making a decrease in inductance as small as possible even at a high current and having direct current (DC) bias characteristics by appropriately adjusting a saturation magnetic flux density of materials in the surrounding region of a coil pattern included in the coil electronic component.

According to an aspect of the present disclosure, a coil electronic component may include: a substrate; a coil pattern formed on at least one of first and second main surfaces of the substrate; a body region filling at least a core region of the coil pattern and having a magnetic material; and a magnetic flux controlling part covering at least the coil pattern and having a material having a saturation magnetic flux density higher than that of a magnetic material contained in the body region.

Through the coil pattern having the form as described above and the magnetic flux controlling part enclosing the coil pattern, a decrease in inductance may be as small as possible even at a high current, and DC bias characteristics may be improved.

BRIEF DESCRIPTION OF DRAWINGS

The above and other aspects, features and other advantages of the present disclosure will be more clearly understood from the following detailed description taken in conjunction with the accompanying drawings, in which.

DETAILED DESCRIPTION

Figure 1:
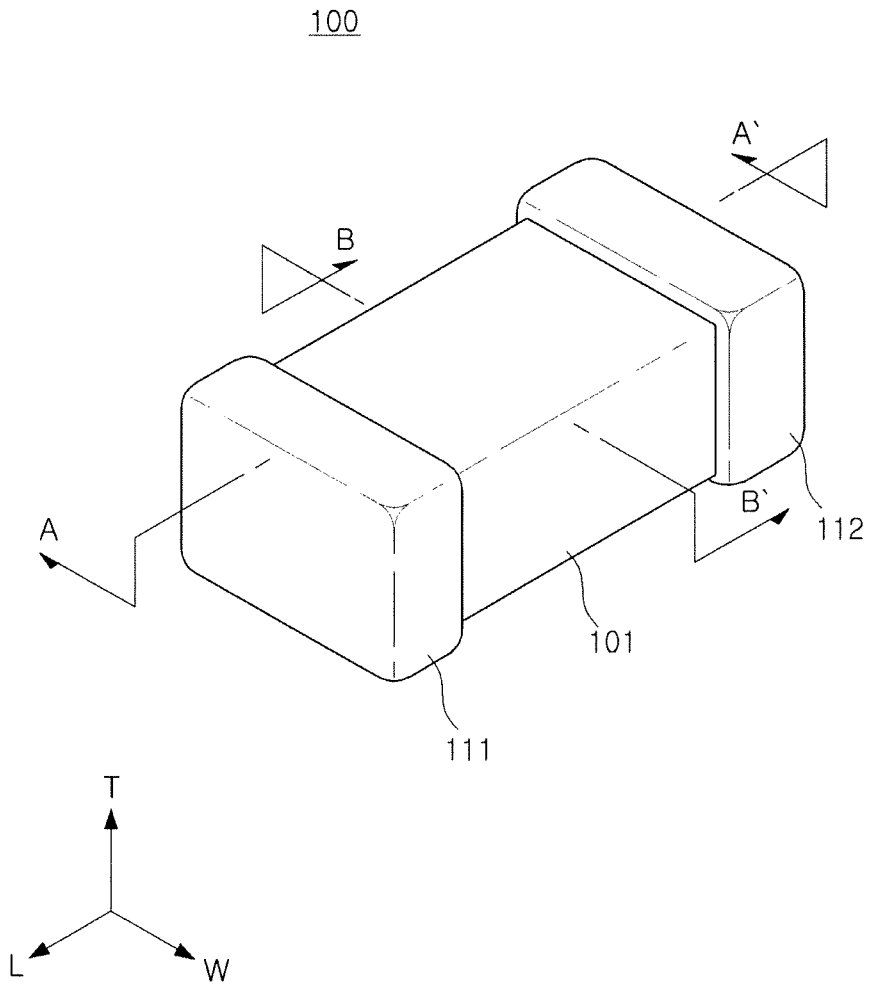
FIG. 1 is a perspective view schematically illustrating an appearance of a coil electronic component according to an exemplary embodiment in the present disclosure.

Hereinafter, embodiments of the present disclosure will be described in detail with reference to the accompanying drawings.

The disclosure may, however, be embodied in many different forms and should not be construed as being limited to the embodiments set forth herein. Rather, these embodiments are provided so that this disclosure will be thorough and complete, and will fully convey the scope of the disclosure to those skilled in the art.

In the drawings, the shapes and dimensions of elements maybe exaggerated for clarity, and the same reference numerals will be used throughout to designate the same or like elements.

Coil Electronic Component

Hereinafter, a coil electronic component according to an exemplary embodiment, particularly, a thin film type inductor will be described by way of example. However, the coil electronic component according to an exemplary embodiment is not necessarily limited thereto.

Figure 2:
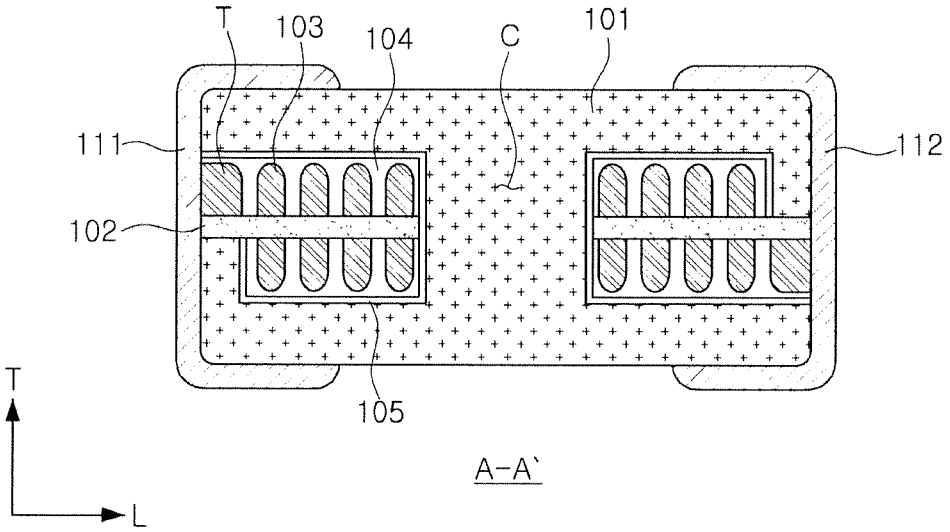
FIG. 2 is a cross-sectional view taken along line A-A' of FIG. 1.
Figure 3:
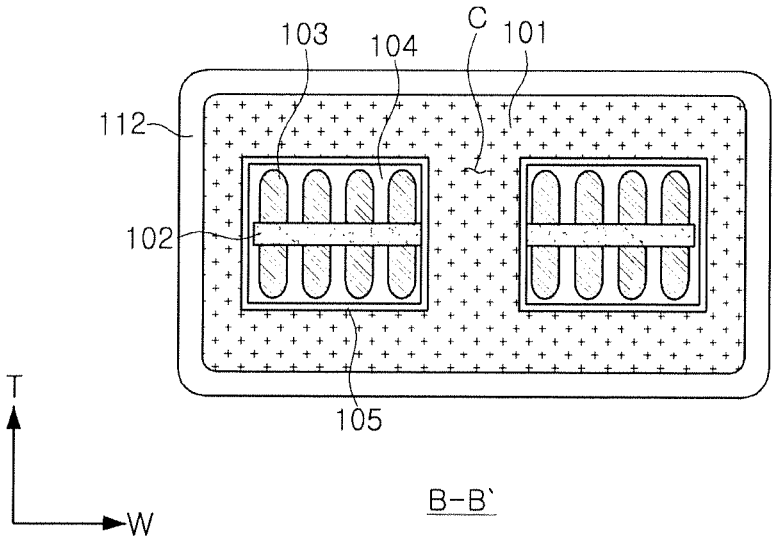
FIG. 3 is a cross-sectional view taken along line B-B' of FIG. 1.
Figure 4:
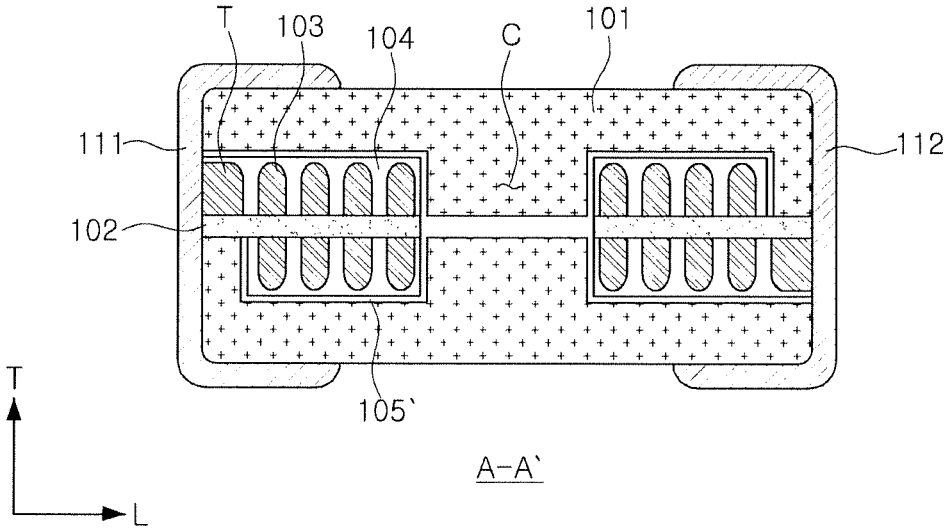
FIGS. 4 and 5 are, respectively, cross-sectional views taken along line A-A' and line B-B' of FIG. 1 illustrating modified examples.
Figure 5:
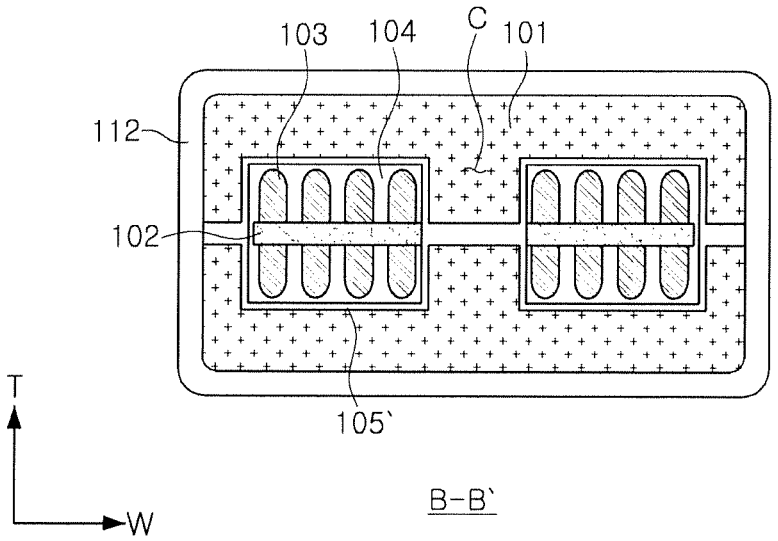

FIG. 1 is a perspective view schematically illustrating an appearance of a coil electronic component according to an exemplary embodiment. In addition, FIG. 2 is a cross-sectional view taken along line A-A' of FIG. 1, and FIG. 3 is a cross-sectional view taken along line B-B' of FIG. 1. Further, FIGS. 4 and 5 are, respectively, cross-sectional views taken along line A-A' and line B-B' of FIG. 1 illustrating modified examples. In this case, in the following description described with reference to FIG. 1, a 'length' direction refers to an 'L' direction of FIG. 1, a 'width' direction refers to a 'W' direction of FIG. 1, and a 'thickness' direction refers to a 'T' direction of FIG. 1.

Referring to FIGS. 1 through 3, a coil electronic component 100 according to an exemplary embodiment may include a substrate 102, a coil pattern 103, a body region 101, an insulating part 104, a magnetic flux controlling part 105, and external electrodes 111 and 112.

The substrate 102 may be disposed in the body region 101 to serve to support the coil pattern 103, and may be, for example, a polypropylene glycol (PPG) substrate, a ferrite substrate, a metal based soft magnetic substrate, or the like. In this case, a through-hole may be formed in a central region of the substrate 102, and a magnetic material may be provided in the through-hole to form a core region C. The core region C may configure a portion of the body region 101. As described above, the core region C in which the magnetic material is provided may be formed, thereby improving performance of the coil electronic component 100.

The coil pattern 103 may be formed on at least one of first and second main surfaces of the substrate 102. In the present exemplary embodiment, the coil patterns 103 are formed on both of the first and second main surfaces of the substrate 102 in order to obtain high inductance. That is, a first coil pattern may be formed on the first main surface of the substrate 102, and a second coil pattern may be formed on the second main surface of the substrate 102 opposing the first main surface of the substrate 102. In this case, the first and second coil patterns may be electrically connected to a via (not illustrated) penetrating through the substrate 102. In addition, the coil pattern 103 may have a spiral shape, and may include a lead portion T formed at the outermost portion of the coil pattern 103 having the spiral shape, wherein the lead portion T is exposed to the outside of the body region 101 for the purpose of electrical connection to the external electrodes 111 and 112.

The coil pattern 103 may be formed of a metal having high electrical conductivity, such as silver (Ag), palladium (Pd), aluminum (Al), nickel (Ni), titanium (Ti), gold (Au), copper (Cu), platinum (Pt), or alloys thereof. In this case, as an example of a preferable process for manufacturing a thin film shape, an electroplating method may be used. Alternatively, other process known in the related art may also be used as long as an effect similar to an effect of the electroplating method may be accomplished.

The insulating part 104 may be formed on a surface of the coil pattern 103 to perform a function of preventing short circuits between adjacent patterns in the coil pattern 103. In order to perform this function, the insulating part 104 maybe formed of an insulating resin, or the like, and may further contain a magnetic material such as ferrite. However, in the present exemplary embodiment, the insulating part 104 may not be a necessarily required component, and in some cases may not be used.

The magnetic flux controlling part 105 may cover the coil pattern 103. In more detail, when the insulating part 104 is used as in the present exemplary embodiment, the magnetic flux controlling part 105 may coat a surface of the insulating part 104. In the present exemplary embodiment, the magnetic flux controlling part 105 may have a material having a saturation magnetic flux density higher than that of a magnetic material contained in the body region 101. The material contained in the magnetic flux controlling part 105 may have the saturation magnetic flux density higher than that of any material or combination of all the materials contained in the body region 101. The magnetic flux controlling part 105 may have a saturation magnetic flux density higher than that of the body region 101.

According to a study of the present inventors, when a current is applied to the coil electronic component 100, direct current (DC) bias characteristics may be changed depending on a saturation magnetic flux density (Ms) of a material contained in the coil pattern 103, and in a case of using a material having a high saturation magnetic flux density, an inductance value may be decreased due to low magnetic permeability. Conversely, in a case in which a material having a low saturation magnetic flux density is used, high inductance may be obtained, but DC bias characteristics may be deteriorated. The present inventors confirmed that a current is concentrated on the coil pattern 103 when it is applied and saturation is made early in the surrounding region of the coil pattern 103. On the basis of this confirmation, the surrounding region of the coil pattern 103 was formed of a material having a relatively high saturation magnetic flux density, and other regions were formed of a material having a saturation magnetic flux density lower than that of the material of the surrounding region of the coil pattern 103, thereby improving the DC bias characteristics and maintaining an inductance value at the same level.

As described above, a magnetic material contained in the magnetic flux controlling part 105 may have a saturation magnetic flux density higher than that of the magnetic material contained in the body region 101. For example, the saturation magnetic flux density may be increased by increasing a content of Fe, or the like, as compared with the magnetic material contained in the body region 101. In addition, in order to perform a function of preventing early saturation, a saturation magnetic flux density of the magnetic material contained in the magnetic flux controlling part 105 may be about 140 emu/g or more, and a thickness of the magnetic flux controlling part 105 may be 10 μm or more.

Meanwhile, the magnetic flux controlling part 105 is not limited to being formed in only the surrounding region of the coil pattern 103. That is, in modified examples of FIGS. 4 and 5, a magnetic flux controlling part 105' may further include a region formed in a sheet shape in the core region C. In addition, the magnetic flux controlling part 105' may also be formed at an outer side of the body region 101 in addition to the core region C. In this case, the magnetic flux controlling part 105' having the sheet shape may also be formed in at least one of the outer side of the body region 101 and the core region C. Regions of the magnetic flux controlling part 105' may be increased as in these modified examples, and thus a magnetic flux saturation level may be more effectively adjusted.

The body region 101 may have a form in which at least the core region C of the coil pattern 103 is filled with the magnetic material, or the like, and may form an appearance of the coil electronic component 100 as in the present exemplary embodiment. In this case, the body region 101 may be formed of any material that shows the above-mentioned magnetic property, that is, any material having the saturation magnetic flux density lower than that of the magnetic material contained in the magnetic flux controlling part 105, and may be formed by providing, for example, ferrite or metal magnetic particles in a resin part.

As a specific example of these materials, the ferrite may be a material such as an Mn—Zn based ferrite, an Ni—Zn based ferrite, an Ni—Zn—Cu based ferrite, an Mn—Mg based ferrite, a Ba based ferrite, an Li based ferrite, or the like, and the body region 101 may have a form in which the ferrite particles are dispersed in a resin such as epoxy, polyimide, or the like.

In addition, the metal magnetic particle may contain one or more selected from the group consisting of Fe, Si, Cr, Al, and Ni. For example, the metal magnetic particle may be a Fe—Si—B—Cr based amorphous metal, but is not necessarily limited thereto. The metal magnetic particles may have a diameter of about 0.1 μm to 30 μm, and the body region 101 may have a form in which the metal magnetic particles are dispersed in a resin such as epoxy, polyimide, or the like, similar to the ferrite particles described above.

Method of Manufacturing Coil Electronic Component

Hereinafter, an example of a method of manufacturing the coil electronic component 100 having the structure described above will be described. Again referring to FIGS. 1 through 3, first, the coil pattern 103 may be formed on the substrate 102. Here, the coil pattern 103 maybe formed using, preferably, a plating process, but is not necessarily limited thereto. As described above, the coil pattern 103 may include a main region having the spiral shape and the lead portion T connected to the main region and disposed at the outermost portion.

Next, the insulating part 104 covering the coil pattern 103 may be formed. The insulating part 104 may be formed by a known method such as a screen printing method, an exposure and development method of a photo-resist (PR), a spray applying method, or the like, depending on a material used.

Next, the magnetic flux controlling part 105 covering the coil pattern 103 may be formed. In more detail, in a case in which the insulating part 104 is used as in the present exemplary embodiment, the magnetic flux controlling part 105 may coat the surface of the insulating part 104. In this case, as described above, the magnetic flux controlling part 105 may be formed of the material having the saturation magnetic flux density higher than that of the magnetic material contained in the body region 101. The magnetic flux controlling part 105 may be formed using an applying method known in the related art. In addition, in a case in which the magnetic flux controlling part 105 includes the region provided in the sheet shape as in the modified examples of FIGS. 4 and 5, the magnetic flux controlling part 105 may be formed using a method of stacking, compressing, and hardening magnetic sheets.

Next, as an example of forming the body region 101, magnetic sheets may be stacked on and beneath the substrate 102 on which the coil pattern 103 is formed, compressed, and then hardened. The magnetic sheets may be manufactured in a sheet shape by mixing metal magnetic powder and organic materials such as a binder, a solvent, and the like, with each other to prepare a slurry, applying the slurry at a thickness of several tens of micrometers onto carrier films by a doctor blade method, and then drying the applied slurry.

The through-hole for the core region C may be formed in the central region of the substrate 102 using a method such as mechanical drilling, laser drilling, sandblasting, punching, or the like. The through-hole may be filled with the magnetic material at the time of stacking, compressing, and hardening the magnetic sheets to form the core region C.

Next, first and second external electrodes 111 and 112 may be formed on surfaces of the body region 101 so as to be each connected to the lead portions T exposed to both surfaces of the body region 101. The external electrodes 111 and 112 may be formed of a paste containing a metal having excellent electrical conductivity, such as a conductive paste containing nickel (Ni), copper (Cu), tin (Sn), silver (Ag), or alloys thereof. In addition, plating layers (not illustrated) maybe further formed on the external electrodes 111 and 112. In this case, the plating layers may contain one or more selected from the group consisting of nickel (Ni), copper (Cu), and tin (Sn). For example, nickel (Ni) layers and tin (Sn) layers may be sequentially formed in the plating layers.

A description of features overlapping those of the coil electronic component according to the exemplary embodiment described above except for the above-mentioned description will be omitted.

The saturation magnetic flux density of the materials in the surrounding region of the coil pattern included in the coil electronic component may be appropriately adjusted, thereby making a decrease in inductance as small as possible even at a high current and improving DC bias characteristics.

While exemplary embodiments have been shown and described above, it will be apparent to those skilled in the art that modifications and variations could be made without departing from the scope of the present invention as defined by the appended claims.

What is claimed is:

1. A coil electronic component comprising:

a substrate;

a coil pattern disposed on at least one of first and second main surfaces of the substrate;

an insulating part disposed on a surface of the coil pattern to prevent short circuits between adjacent patterns in the coil pattern;

a body region filling at least a core region of the coil pattern and having a magnetic material; and a magnetic flux controlling part coated on a surface of the insulating part and having a material having a saturation magnetic flux density higher than that of a magnetic material contained in the body region, wherein a content of Fe contained in the magnetic flux controlling part is greater than a content of Fe contained in the body region.

2. The coil electronic component of claim 1, wherein the insulating part is made of an insulating resin and a magnetic material.

3. The coil electronic component of claim 1, wherein the magnetic flux controlling part includes a region formed in a sheet shape in the core region.

4. The coil electronic component of claim 1, wherein a saturation magnetic flux density of the magnetic material contained in the magnetic flux controlling part is 140emu/g or more.

5. The coil electronic component of claim 1, wherein a thickness of the magnetic flux controlling part is 10 μm or more.

6. The coil electronic component of claim 1, wherein the coil pattern is formed by plating.

7. The coil electronic component of claim 1, wherein the coil pattern includes first and second coil patterns disposed on the first and second main surfaces of the substrate, respectively.

8. The coil electronic component of claim 1, wherein the coil pattern includes a lead portion exposed to the outside of the body region.

9. The coil electronic component of claim 8, further comprising external electrodes disposed on surfaces of the body region and connected to the lead portion.

10. The coil electronic component of claim 1, wherein the body region contains metal magnetic powder and a thermosetting resin.

11. The coil electronic component of claim 1, wherein the body region includes first and second body regions completely separated from each other by the magnetic flux controlling part.

12. The coil electronic component of claim 1, wherein the magnetic flux controlling part having the material having the saturation magnetic flux density higher than any material contained in contained in the body region.

13. The coil electronic component of claim 1, wherein the magnetic flux controlling part having a saturation magnetic flux density higher than that of the body region.

14. A coil electronic component comprising:

a substrate;

a coil pattern disposed on the substrate;

a body region embedding the substrate and the coil pattern;

a magnetic flux controlling part disposed between the coil pattern and the body region and having a saturation magnetic flux density higher than that of the body region; and an insulating part disposed between the magnetic flux controlling part and the coil pattern and made of an insulating resin and a magnetic material.

15. The coil electronic component of claim 14, wherein a thickness of the magnetic flux controlling part is 10 μm or more.

16. The coil electronic component of claim 14, wherein the magnetic flux controlling part includes a region formed in a sheet shape in a core region at a center of the coil electronic component.

17. The coil electronic component of claim 14, wherein the body region includes first and second body regions completely separated from each other by the magnetic flux controlling part.

18. The coil electronic component of claim 14, wherein the coil pattern includes a lead portion exposed to the outside of the body region, the coil electronic component further comprises external electrodes disposed on surfaces of the body region and connected to the lead portion.

* * * * *